US009850614B2

(12) United States Patent
Chiriatti

(10) Patent No.: US 9,850,614 B2
(45) Date of Patent: Dec. 26, 2017

(54) MACHINE FOR WASHING OR DRYING LAUNDRY

(71) Applicant: WHIRLPOOL CORPORATION, Benton Harbor, MI (US)

(72) Inventor: Antonio Chiriatti, Schorndorf (DE)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/074,220

(22) Filed: Mar. 18, 2016

(65) Prior Publication Data

US 2016/0273147 A1 Sep. 22, 2016

(30) Foreign Application Priority Data

Mar. 19, 2015 (DE) ..... 20 2015 101 403 U

(51) Int. Cl.

| | |
|---|---|
| ***D06F 37/20*** | (2006.01) |
| ***D06F 58/08*** | (2006.01) |
| ***D06F 37/22*** | (2006.01) |
| ***D06F 37/30*** | (2006.01) |
| ***D06F 58/06*** | (2006.01) |
| *D06F 37/00* | (2006.01) |

(52) U.S. Cl.

CPC ..... *D06F 37/20* (2013.01); *D06F 37/22* (2013.01); *D06F 37/304* (2013.01); *D06F 58/06* (2013.01); *D06F 58/08* (2013.01); *D06F 37/00* (2013.01)

(58) Field of Classification Search

CPC ..... D06F 37/00; D06F 37/20; D06F 37/32; D06F 37/304; D06F 58/06; D06F 58/08

USPC ..... 34/108, 595–610

See application file for complete search history.

(56) References Cited

U.S. PATENT DOCUMENTS

| | | | | |
|---|---|---|---|---|
| 2,321,079 | A * | 6/1943 | Greenwald | E05F 15/50 49/137 |
| 2,709,908 | A * | 6/1955 | Altorfer, Jr. | D06F 13/02 68/12.12 |
| 2,975,626 | A * | 3/1961 | Frey | D06F 25/00 68/139 |
| 3,091,956 | A * | 6/1963 | Brucken | D06F 13/04 192/30 R |
| 3,262,661 | A | 7/1966 | Johnson et al. | |
| 3,583,182 | A * | 6/1971 | Matsuura | D06F 37/203 210/144 |
| 7,533,548 | B2 | 5/2009 | Chang | |

(Continued)

FOREIGN PATENT DOCUMENTS

| | | | |
|---|---|---|---|
| CN | 102021783 | A | 4/2011 |
| DE | 19546185 | A1 | 6/1997 |

(Continued)

OTHER PUBLICATIONS

European Search Report for Counterpart EP16161163.7, dated Jul. 27, 2016.

*Primary Examiner* — Stephen M Gravini

(57) ABSTRACT

A machine for washing or drying laundry, having a stationary part, a tub, a drum rotatably accommodated in the tub, and a drive motor. The drive motor comprises a stator or housing component connected to the machine, a rotor having a rotor shaft connected with the drum, and bearings arranged in the stator or a housing component, and the rotor shaft is rotatably mounted by the bearings. One or more spring or damping elements connects the stator or housing component to the stationary part.

18 Claims, 2 Drawing Sheets

(56) References Cited

U.S. PATENT DOCUMENTS

| | | | | |
|---|---|---|---|---|
| 7,568,366 | B2 | 8/2009 | Chang et al. | |
| 7,571,625 | B2 | 8/2009 | Chang | |
| 7,574,879 | B2 | 8/2009 | Chang et al. | |
| 7,607,326 | B2 | 10/2009 | Chang et al. | |
| 7,827,834 | B2 | 11/2010 | Lim et al. | |
| 7,841,220 | B2 | 11/2010 | Lim et al. | |
| 7,900,487 | B2 | 3/2011 | Lim | |
| 7,930,910 | B2 | 4/2011 | Chang | |
| 8,033,145 | B2 * | 10/2011 | Komori | D06F 23/06 68/23 R |
| 8,156,770 | B2 | 4/2012 | Chang | |
| 8,166,782 | B2 | 5/2012 | Lim et al. | |
| 8,186,185 | B2 | 5/2012 | Lim et al. | |
| 8,201,422 | B2 | 6/2012 | Lim et al. | |
| 8,220,294 | B2 | 7/2012 | Lim et al. | |
| 8,225,628 | B2 | 7/2012 | Lim et al. | |
| 8,234,890 | B2 | 8/2012 | Lim et al. | |
| RE43,625 | E | 9/2012 | Kim et al. | |
| 8,302,434 | B2 | 11/2012 | Chang | |
| 8,322,170 | B2 | 12/2012 | Chang | |
| 8,336,339 | B2 | 12/2012 | Chang | |
| 8,336,340 | B2 | 12/2012 | Chang | |
| 8,341,983 | B2 | 1/2013 | Chang | |
| RE44,028 | E | 2/2013 | Kim et al. | |
| 8,387,421 | B2 | 3/2013 | Chang | |
| 8,429,938 | B2 | 4/2013 | Chang et al. | |
| 8,434,334 | B2 | 5/2013 | Chang et al. | |
| 8,516,716 | B2 * | 8/2013 | Dal Ben | D06F 37/26 34/601 |
| RE44,511 | E | 10/2013 | Kim et al. | |
| RE44,674 | E | 12/2013 | Kim et al. | |
| 8,616,027 | B2 | 12/2013 | Chang | |
| 8,616,029 | B2 | 12/2013 | Maentele et al. | |
| 8,646,292 | B2 | 2/2014 | Chang | |
| 8,646,293 | B2 | 2/2014 | Chang | |
| RE44,795 | E | 3/2014 | Kim et al. | |
| 8,671,718 | B2 | 3/2014 | Lim et al. | |
| 8,677,787 | B2 | 3/2014 | Chang et al. | |
| 8,701,448 | B2 | 4/2014 | Jang et al. | |
| 8,726,702 | B2 | 5/2014 | Chang et al. | |
| 8,783,072 | B2 | 7/2014 | Chang et al. | |
| 8,800,326 | B2 | 8/2014 | Chang et al. | |
| 8,857,225 | B2 | 10/2014 | Barzizza et al. | |
| 8,887,537 | B2 | 11/2014 | Chang | |
| 8,887,538 | B2 | 11/2014 | Chang et al. | |
| 8,931,312 | B2 | 1/2015 | Chang et al. | |
| 8,997,533 | B2 | 4/2015 | Kim et al. | |
| 9,127,397 | B2 | 9/2015 | Moon et al. | |
| 2005/0274159 | A1 | 12/2005 | Jeon et al. | |
| 2006/0075791 | A1 | 4/2006 | Seo et al. | |
| 2006/0254321 | A1 | 11/2006 | Lim et al. | |
| 2009/0044574 | A1 | 2/2009 | Lim et al. | |
| 2011/0100069 | A1 | 5/2011 | Chang et al. | |
| 2011/0283743 | A1 | 11/2011 | Song et al. | |
| 2012/0006067 | A1 | 1/2012 | Lim et al. | |
| 2012/0006068 | A1 | 1/2012 | Song et al. | |
| 2012/0011901 | A1 | 1/2012 | Kwon et al. | |
| 2012/0024020 | A1 | 2/2012 | Kwon et al. | |
| 2012/0031151 | A1 | 2/2012 | Jo et al. | |
| 2012/0042496 | A1 | 2/2012 | Chang et al. | |
| 2012/0047962 | A1 | 3/2012 | Chang | |
| 2012/0047964 | A1 | 3/2012 | Chang et al. | |
| 2012/0047965 | A1 | 3/2012 | Chang et al. | |
| 2012/0047969 | A1 | 3/2012 | Chang et al. | |
| 2012/0055207 | A1 | 3/2012 | Chang et al. | |
| 2012/0055208 | A1 | 3/2012 | Kwon et al. | |
| 2012/0090362 | A1 | 4/2012 | Hwang et al. | |
| 2012/0104912 | A1 | 5/2012 | Song et al. | |
| 2012/0118024 | A1 | 5/2012 | Kwon et al. | |
| 2012/0240637 | A1 | 9/2012 | Lim et al. | |
| 2012/0260520 | A1 | 10/2012 | Hong et al. | |
| 2013/0145799 | A1 | 6/2013 | Lee et al. | |
| 2014/0123712 | A1 | 5/2014 | Kim et al. | |
| 2014/0157833 | A1 | 6/2014 | Hong et al. | |
| 2014/0223971 | A1 | 8/2014 | Hong et al. | |
| 2015/0020554 | A1 | 1/2015 | Kim et al. | |
| 2016/0177486 | A1 * | 6/2016 | Erickson | D06F 37/22 68/140 |
| 2016/0273147 | A1 * | 9/2016 | Chiriatti | D06F 58/06 |
| 2017/0121894 | A1 * | 5/2017 | Hwang | D06F 39/10 |

FOREIGN PATENT DOCUMENTS

| | | | | |
|---|---|---|---|---|
| DE | 19963703 | A1 | 7/2001 | |
| EP | 1433890 | A2 | 6/2004 | |
| EP | 1246962 | B1 | 5/2006 | |
| EP | 1840257 | A1 | 10/2007 | |
| EP | 2119819 | A1 | 11/2009 | |
| EP | 2161366 | A1 | 3/2010 | |
| EP | 2161367 | A1 | 3/2010 | |
| EP | 2228481 | A1 * | 9/2010 | D06F 37/304 |
| EP | 2460925 | A1 | 6/2012 | |
| EP | 2722971 | A2 | 4/2014 | |
| EP | 2826907 | A1 | 1/2015 | |
| ES | 2463168 | A1 | 5/2014 | |
| ES | 2463315 | A2 | 5/2014 | |
| ES | 2463487 | A1 | 5/2014 | |
| ES | 2464242 | A2 | 5/2014 | |
| FR | 1513957 | A | 2/1968 | |
| KR | 100531319 | B1 | 11/2005 | |
| KR | 100662361 | B1 | 1/2007 | |
| KR | 100807836 | B1 | 2/2008 | |
| KR | 20100080461 | A | 7/2010 | |
| KR | 20100129157 | A | 12/2010 | |
| KR | 20120101796 | A | 9/2012 | |
| KR | 20120102298 | A | 9/2012 | |
| KR | 20130005042 | A | 1/2013 | |
| WO | 2011091941 | A1 | 8/2011 | |

* cited by examiner

MACHINE FOR WASHING OR DRYING LAUNDRY

CROSS REFERENCE TO RELATED APPLICATIONS

This application claims the benefit of German Application No. 2020151014031, filed Mar. 19, 2015, the entirety of which is incorporated herein by reference.

BACKGROUND OF THE INVENTION

The invention concerns a machine for washing or drying laundry.

In prior washing machines a drum is rotatably mounted in a container and which is driven by an electric drive motor. The stator of the drive motor is supported on a flange of the container. The rotor shaft of the drive motor is accommodated in a first bearing in the stator and in a second bearing in the container such that it can rotate. The bearing in the container is located in a hub that is integrally cast in the container made of plastic.

Vibrations and imbalances which arise with a rotating drum are also transferred via the drive motor to the container on which the drive motor is supported. Imbalances may lead to damage to the bearings and to the connections between the components. In order to keep the forces acting on the container during operation small, and in order to avoid damages, a high rigidity is therefore important in the connection between drive motor and container or the components involved given an axial alignment of the bearings.

BRIEF SUMMARY OF EMBODIMENTS OF THE INVENTION

One illustrative embodiment relates to a machine for washing or drying laundry, comprising a stationary part, a tub, a drum rotatably accommodated in the tub, and a drive motor. The drive motor comprises a stator or housing component connected to the machine, a rotor having a rotor shaft connected with the drum, and bearings arranged in the stator or a housing component, and the rotor shaft is exclusively rotatably mounted by the bearings. One or more spring or damping elements connects the stator or housing component to the stationary part.

One benefit of the embodiments is to reduce, with simple design measures, the forces acting on a machine for washing or drying during operation.

Another embodiment relates to a machine such as a washing machine, a laundry dryer, or a washer-dryer that combines both the function of washing and that of drying. The machine has a drum as well as a direct drive motor that drives the drum, and a tub in which the drum is accommodated such that it can rotate. The machine may be both a front loader and a top loader.

Another embodiment relates to the rotor shaft of the rotor of the drive motor is accommodated in at least two axially spaced bearings such that it can rotate. The bearings are located exclusively in the stator or in a housing component of the drive motor that is firmly connected with the stator. In contrast to this, the rotor shaft is not mounted rotatably in the tub which accommodates the drum of the machine.

The embodiments have the advantage that no bearing for the rotor shaft of the drive motor is required at the container or tub that accommodates the drum. The stator or a housing component of the drive motor is supported via damping elements at the tub or another stationary part of the machine, whereby the forces acting on the tub or the other stationary part of the machine are significantly reduced. This allows for the tub or the other stationary part of the machine to be designed with a lower stability, and to be made with thinner walls, for example. A direct transfer of forces and vibration excitations from the rotor shaft to the tub does not occur.

In yet another embodiment, the drive motor comprises a stator and a housing component connected with said stator, said stator and housing component being respectively shaped like pots and connected with one another in the region of their end walls. A bearing for the rotor shaft is respectively accommodated both in the stator or in a housing component accommodating the stator, and in the additional housing component. This ensures a sufficiently large axial distance between the bearings, and therefore a smooth running free of imbalances. The forces acting on the bearings are reduced due to the relatively large axial distance between the bearings. The stator may be accommodated directly in a housing component in which the stator-side bearing is located.

Into each component accommodating the bearing is advantageously integrated a hub, into which the respective bearing is inserted. By way of example, the housing component is designed as a plastic component that may be produced in an injection molding process, wherein the hub is insert-molded using the plastic material. The stator may possibly also be made as a plastic component, wherein the hub is insert-molded using the plastic material of the stator.

The stator of the drive motor is a support for components for generating a magnetic or electromagnetic field. According to an advantageous embodiment, the stator is a support for coils that can be fed with current, and the rotor is a support for permanent magnets.

It is thus an electronically commutated, permanently excited synchronous motor.

In yet another embodiment, the stator faces the drum. In this embodiment, the rotor is located on the side facing away from the drum. This embodiment has the advantage that the stator is located at only a slight distance from the machine, and may be connected with the machine via correspondingly compactly dimensioned connection elements. It is also advantageous that the heat that is produced in the stator is transferred to the tub and contributes to the heating of the water. Moreover, the result of the spin process is improved.

The connection between the drive motor and the tub or the machine housing advantageously takes place via a spring-damper system, wherein a bellows may also possibly be provided, which has the advantage that the connection is simultaneously designed to be water-tight. For example, it is possible to arrange a spring-damper system between the stator or a housing component of the drive motor and the machine housing, and to arrange a bellows between the stator or a housing component of the drive motor and the tub. The bellows may compensate for relative movements between the drive motor and the tub.

According to a further advantageous embodiment, the stator may comprise a stator ring which is a support for coils to which current may be fed. The stator ring is advantageously arranged at a housing component of the electric drive motor. This housing component may be made as an injection-molded plastic component into which the stator ring is inserted, said stator ring being insert-molded using the material of the housing component. This housing component accommodating the stator ring, with a first bearing in the stator ring for the rotor shaft is advantageously connected with a second housing component into which a bearing for the rotor shaft is likewise introduced. The two housing components are respectively of pot-shaped design, for example, wherein the pot edges face one another and are connected with one another.

The stator ring may also possibly be produced in an injection-molding process. The stator ring is in particular comprised of a thermally and/or electrically resistive material.

BRIEF DESCRIPTION OF THE DRAWINGS

Additional advantages and appropriate embodiments are to be taken from the additional claims, with reference to the attached drawings, wherein:

In the Figures, identical components are provided with the same reference sign.

DETAILED DESCRIPTION OF EMBODIMENTS OF THE INVENTION

The machine depicted in the exemplary embodiments is, for example, a washing machine, a laundry dryer or a combination of washing machine and dryer (washer-dryer).

Figure 1:
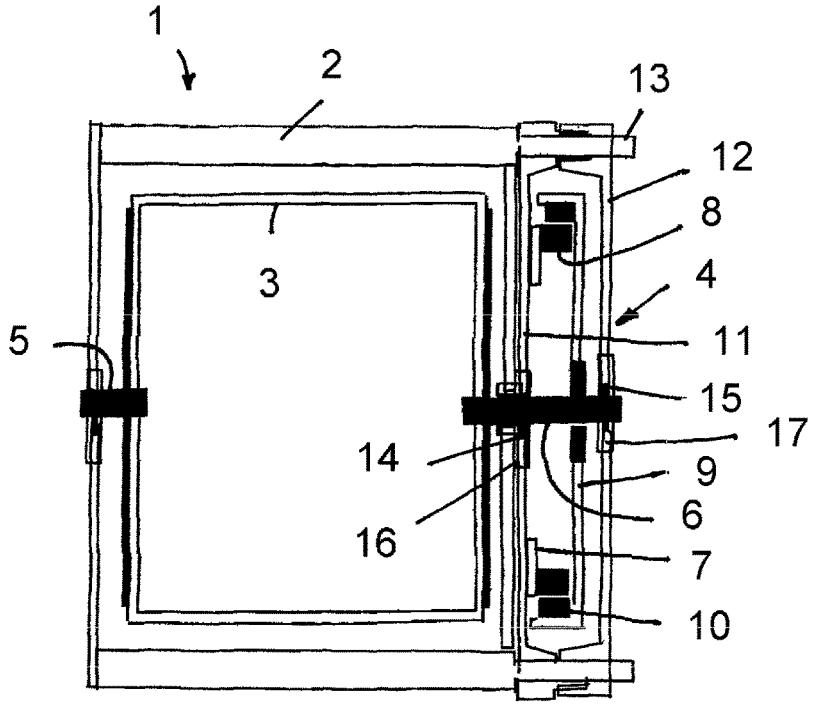
FIG. 1 is a section view from a machine for washing or drying according to prior art, with a drum that is mounted rotatably in a tub and that is driven by an electric drive motor whose rotor shaft is exclusively rotatably accommodated in bearings of the drive motor.

Depicted in the prior art embodiment according to FIG. 1 is a machine 1 with a tub 2 that is arranged in a fixed manner with respect to the housing, and a drum 3, as well as an electric drive motor 4. The drum 3 is accommodated in the tub 2 and mounted rotatably in the tub. The mounting of the drum 3 takes place via a bearing shaft 5 via which the drum 3 is accommodated rotatably directly at the tub 2, as well as opposite the bearing shaft 5 via a rotor shaft 6 of the electric drive motor 4.

The electric drive motor 4 is an electronically commutated, permanently excited synchronous motor with a stator 7 that is designed as a stator ring and bears multiple coils 8 that can be fed with current and are distributed over the circumference, as well as a rotor 9 on whose circumference permanent magnets 10 are arranged. The permanent magnets 10 are situated radially outward from the associated coils 8 on the stator 7 and encompass the coils 8. Furthermore belonging to the drive motor 4 are two housing components 11 and 12, of which the housing component 11 bears the stator 7 which is designed as a ring and located on the side facing the drum 3. The two housing components 11 and 12 are respectively designed in the shape of a disc and have, in the manner of a pot, an axially projecting edge region at their periphery, wherein the free faces of the edge region of the housing components 11, 12 face one another and are connected with one another in this region. If applicable, the faces of the edge may positively engage in one another.

In the prior art embodiment according to FIG. 1, pins 13 that are fashioned in one piece with the tub 2 or are arranged on the tub 2 and project from the tub axially protrude into associated recesses that are introduced into the edge region of the housing components 11 and 12.

Belonging to the rotor 9 of the electric drive motor 4 is the rotor shaft 6, which is rotatably accommodated in two bearings 14 and 15, which are located in the housing components 11 and 12. Into each housing component 11 and 12, a central hub 16, 17 is introduced that is the support for the bearing 14 or 15. The rotor shaft 6 of the rotor 9 is rotatably accommodated exclusively in the two bearings 14 and 15.

The rotor shaft 6 projects through a cutout in a side wall of the tub 2 and is connected with the drum 3 so as to be rotationally fixed. When feeding current to the drive motor 4, the drum 3 also rotates accordingly in the tub 2.

The stator 7, including the housing component 11 in which the stator 7 of the drive motor is accommodated, is situated on the side adjacent to the drum 3 or the tub 2. In the exemplary embodiment according to FIG. 1, the support of the housing components 11 and 12 of the drive motor 4 takes place exclusively at the tub 2. Support elements, in particular damping or spring elements, may be located between the drive motor 4 and the tub 2, likewise between a machine housing accommodating the tub 2 and the drive motor 4.

Figure 2:
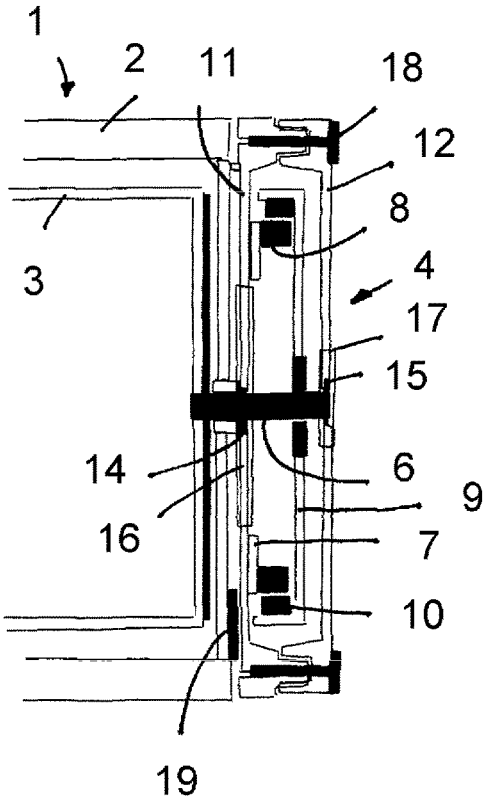
FIG. 2 is an embodiment variant of the machine according to prior art.

The exemplary embodiment according to FIG. 2 largely corresponds to that of FIG. 1, but with the difference that the two housing components 11 and 12 of the drive motor 4 are connected with one another in their outlying edge region via axially introduced fastening pins 18. The housing component 11 of the drive motor is connected via one or more connection elements 19 with the side wall of the tub 2.

The above known solutions have the disadvantage of transmitting high forces due to an unbalanced load in the drum to the tub and the housing of the washing machine.

Figure 3:
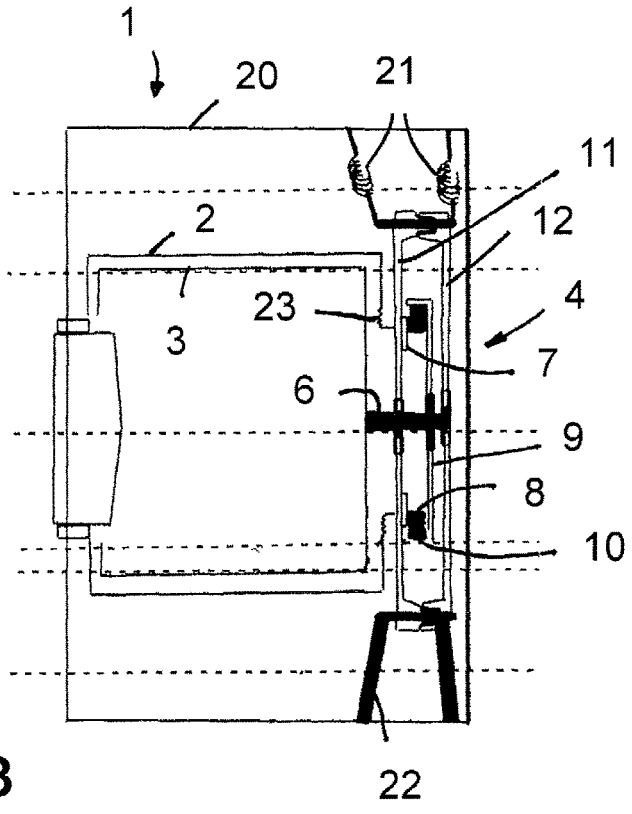
FIG. 3 is a section view of the washing machine according to the invention in which the direct drive motor is supported on a machine housing that accommodates the tub including drum.

According to the invention shown in two different views (FIG. 3 and FIG. 4) a machine 1 is shown with a tub 2 for accommodating a rotatably mounted drum 3, and with a machine housing 20 in which the tub 2 including the drum 3 and the electric drive motor 4 are accommodated. The support of the electric drive motor 4 takes place directly at the accommodating machine housing 20, in contrast to which no support of the drive motor 4 takes place at the tub 2. The two housing components 11 and 12 of the drive motor 4 are supported via a spring element 21 as well as via a support element 22 on the machine housing 20.

A connection between the stator-side housing component 11, which faces the tub 2 directly, and the tub 2 exists via a bellows 23, which does not, however, accept support forces but merely establishes an in particular water-tight connection between tub 2 and drive motor 4. The bellows 23 is able to compensate via expansion for vibrations which originate from the drive motor 4 or the drum 3.

Figure 4:
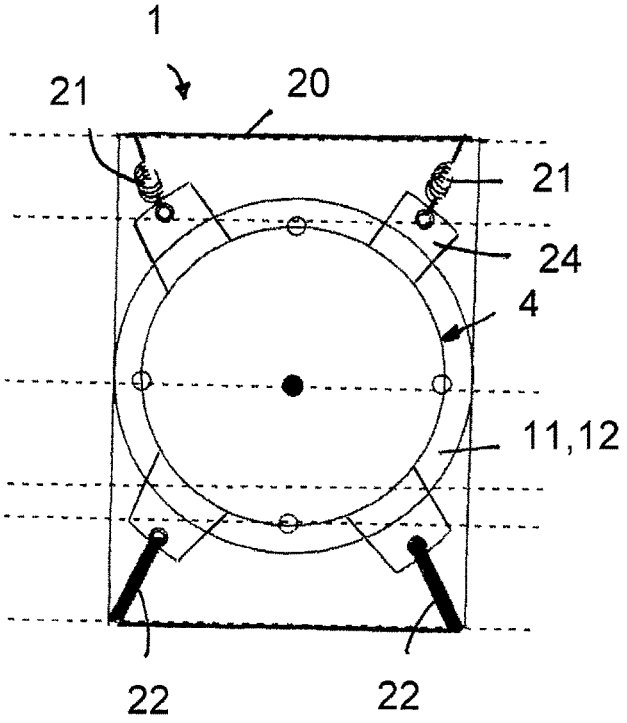
FIG. 4 is a frontal view of the machine according to FIG. 3.

As can be seen in FIG. 4, on the stator-side housing components 11, 12 are molded lugs 24, to which both the spring elements 21 and the support elements 22 are attached.

The spring elements 21, as well as possibly also the support elements 22, together form a spring-damper system for supporting and mounting the drive motor 4 on the machine housing 20.

What is claimed is:

1. A machine for washing or drying laundry, comprising:

a machine housing;

a tub disposed within the machine housing;

a drum rotatably mounted within the tub;

a motor having a motor housing defining an interior and an exterior, a stator and a rotor disposed within the interior and molded lugs disposed on the exterior of the motor housing, with the molded lugs extending outward from the exterior;

a bellows connecting the tub to the motor housing and configured to establish a water-tight connection between the tub and the motor; and a spring-damper system including:

a spring element supported by the machine housing and coupled with a first set of at least two of the molded lugs disposed on the exterior of the motor housing; and a support element supported by the machine housing and coupled with a second set of at least two of the molded lugs disposed on the exterior of the motor housing;

wherein the spring-damper system is configured such that the motor is supported by the machine housing.

2. The machine of claim 1 wherein the motor housing includes at least a first motor housing and a second motor housing.

3. The machine of claim 2 wherein the first motor housing is positioned to face the drum and the second motor housing is positioned to face the machine housing.

4. The machine of claim 3 wherein the bellows connects to the first motor housing.

5. The machine of claim 4 wherein the first motor housing includes a radial surface and the bellows connects to the radial surface of the first motor housing.

6. The machine of claim 1 wherein the spring-damper system only directly supports the motor.

7. The machine of claim 1 wherein the motor housing includes a first set of at least two adjacent molded lugs and a second set of at least two adjacent molded lugs, wherein the first set of at least two adjacent molded lugs is different than the second set of at least two adjacent molded lugs.

8. The machine of claim 7 wherein the first set of at least two adjacent molded lugs are coupled with spring elements.

9. The machine of claim 8 wherein the second set of at least two adjacent molded lugs are coupled with support elements.

10. The machine of claim 9 wherein the first set of at least two adjacent molded lugs are positioned horizontally above the second set of at least two adjacent molded lugs.

11. The machine of claim 1 wherein the spring element is a tension spring element.

12. The machine of claim 1 wherein the motor is rotatably connected with the drum.

13. The machine of claim 12 wherein the bellows is not configured to accept support forces from the motor, tub, or drum.

14. The machine of claim 12 wherein the bellows is expandable and is configured to compensate relative movements between the motor and the tub by way of expansion.

15. The machine of claim 1 wherein the spring-damper system is configured to dampen forces acting on the motor.

16. The machine of claim 1 wherein the spring-damper system is configured to dampen forces acting on the tub.

17. The machine of claim 1 wherein the motor housing includes bearings configured to support a rotor shaft.

18. The machine of claim 17 wherein the rotor shaft is not mounted to the tub.

* * * * *